US006584694B2

(12) United States Patent
Chen

(10) Patent No.: US 6,584,694 B2
(45) Date of Patent: Jul. 1, 2003

(54) INTEGRALLY-MADE ULTRATHIN CIRCULAR BLADE OF CUTTING TOOL

(76) Inventor: Shan-Ming Chen, P.O. Box 453, Taichung (TW)

( * ) Notice: Subject to any disclaimer, the term of this patent is extended or adjusted under 35 U.S.C. 154(b) by 0 days.

(21) Appl. No.: 09/931,741

(22) Filed: Aug. 20, 2001

(65) Prior Publication Data

US 2003/0033720 A1 Feb. 20, 2003

(51) Int. Cl.[7] ..... B26B 25/00

(52) U.S. Cl. ..... 30/307

(58) Field of Search ..... 32/307, 319, 164.95; D7/694; 30/276, 347

(56) References Cited

U.S. PATENT DOCUMENTS 430,669 A * 6/1890 McDonald ..... 30/276
2,472,876 A * 6/1949 Ahrndt et al.

* cited by examiner

*Primary Examiner*—Douglas D. Watts
(74) *Attorney, Agent, or Firm*—Harrison & Egbert

(57) ABSTRACT

A circular blade of the cutting tool is provided with a reinforcing portion circumventing a fastening hole by which the circular blade is fastened to one end of the handle of the cutting tool. The reinforcing portion serves to enhance the structural strength of the circular blade, and to reduce the mechanical friction between the circular blade and the one end of the handle of the cutting tool. The reinforcing portion also serves to eliminate the internal stress of the circular blade at the time when the circular blade is subjected to a finishing process.

1 Claim, 8 Drawing Sheets

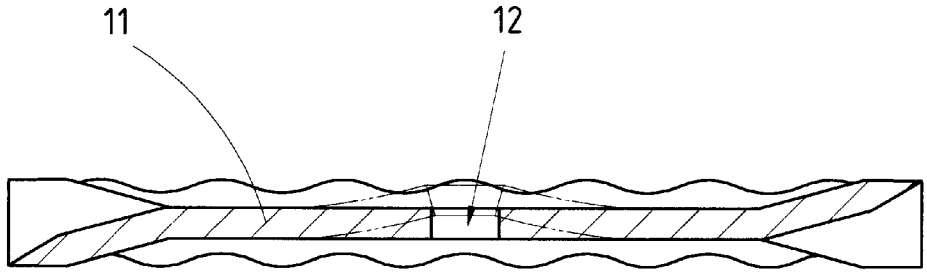
FIG.2-A PRIOR ART
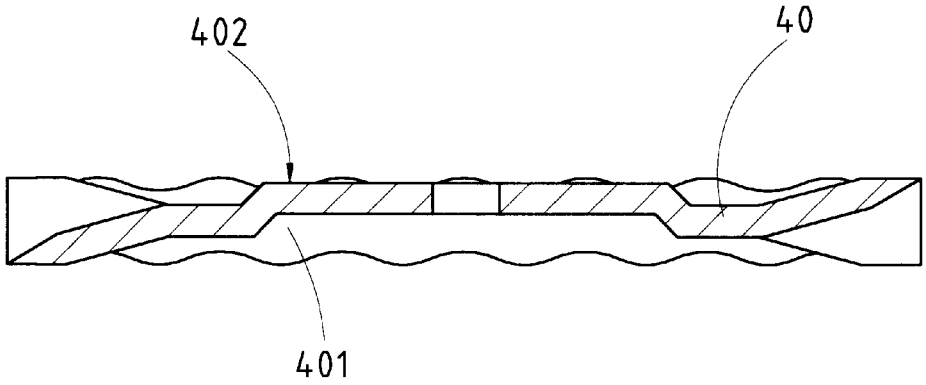
FIG.2-B PRIOR ART

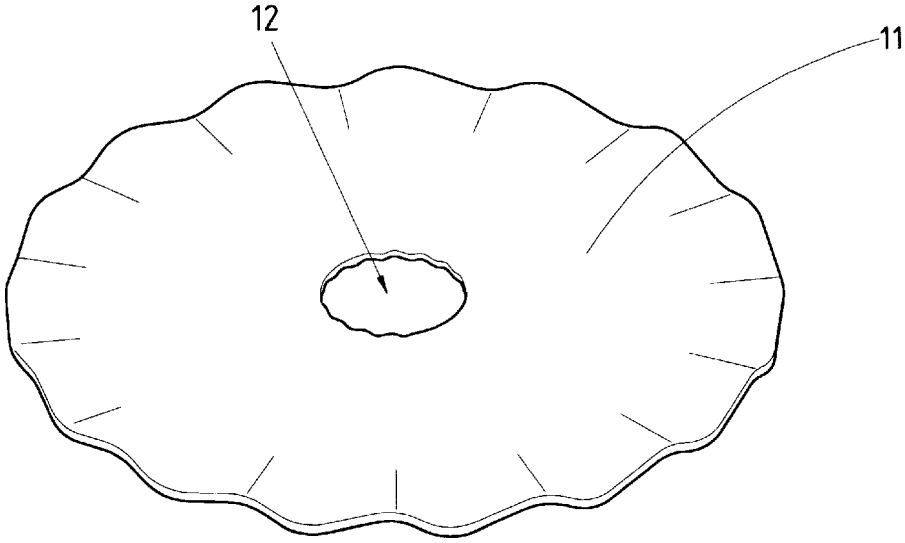
FIG.3-A PRIOR ART
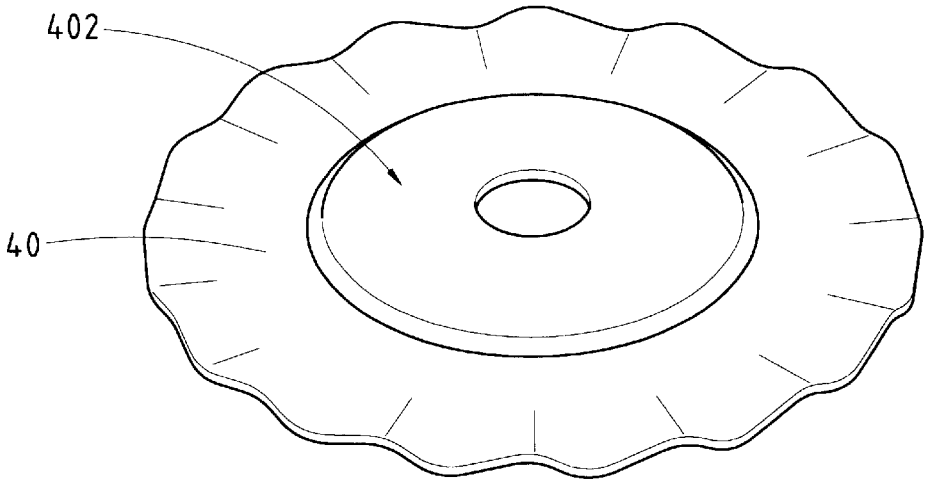
FIG.3-B PRIOR ART

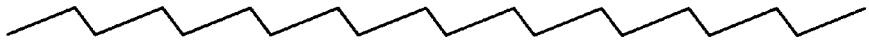
FIG.8-A
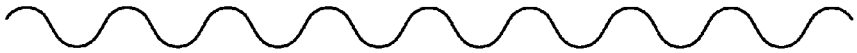
FIG.8-B
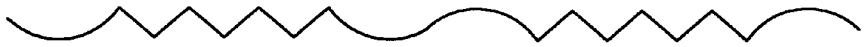
FIG.8-C
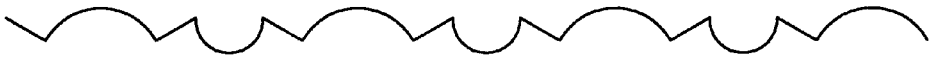
FIG.8-D

INTEGRALLY-MADE ULTRATHIN CIRCULAR BLADE OF CUTTING TOOL

BACKGROUND OF THE INVENTION

1. Field of the Invention

The present invention relates generally to a cutting tool, and more particularly to a circular blade of the cutting tool.

2. Description of Related Art

As shown in FIGS. 1, 2A, and 3A, a prior art circular blade 11 of a cutting tool 10 is made integrally and is provided at the center thereof with a fastening hole 12. The circular blade 11 is fastened to one end of a handle 16 by a fastening bolt 13 and a nut 15. The fastening bolt 13 is engaged with the nut 15 via the fastening hole 12 of the circular blade 11. The prior art circular blade 11 is defective in design in that it is susceptible to a minute deformation in the course of finishing process, and that its structural strength is inadequate. In addition, the prior art circular blade 11 does not work smoothly due to the mechanical friction between the circular blade 11 and other component parts of the cutting tool 10.

As shown in FIGS. 2B and 3B, another prior art circular blade 40 is provided with a recess 401, which is intended to alleviate the deformation that is caused in the finishing process. However, the working of this prior art circular blade 40 is hampered by the mechanical friction between the planar portion 402 of the circular blade 40 and other component parts of the cutting tool. In addition, the structural strength of the circular blade 40 is insufficient to meet the work requirement.

BRIEF SUMMARY OF THE INVENTION

It is the primary objective of the present invention to provide a circular blade which is free of the deficiencies of the prior art circular blades described above.

In keeping with the principle of the present invention, the foregoing objective of the present invention is attained by the circular blade having a fastening hole, a reinforcing portion, and a cutting edge. The reinforcing portion serves to strengthen the structure of the circular blade, reduce the contact area between the circular blade and other component parts of the cutting tool, and prevent the deformation of the circular blade in the course of finishing process.

The foregoing objective, feature and function of the present invention will be more readily understood upon a thoughtful deliberation of the following detailed description of the present invention with reference to the accompanying drawings.

BRIEF DESCRIPTION OF THE SEVERAL VIEWS OF THE DRAWINGS

FIG. 2A shows a sectional view of a circular blade of the prior art cutting tool as shown in FIG. 1.

FIG. 2B shows a sectional view of another prior art circular blade.

FIG. 3A shows a perspective view of the prior art circular blade as shown in FIG. 2A.

FIG. 3B shows a perspective view of the prior art circular blade as shown in FIG. 2B.

FIGS. 8A, 8B, 8C, and 8D are schematic views to show that the circular blade of the present invention has a regularly-serrated cutting edge or an irregularly-serrated cutting edge.

DETAILED DESCRIPTION OF THE INVENTION

Figure 1:
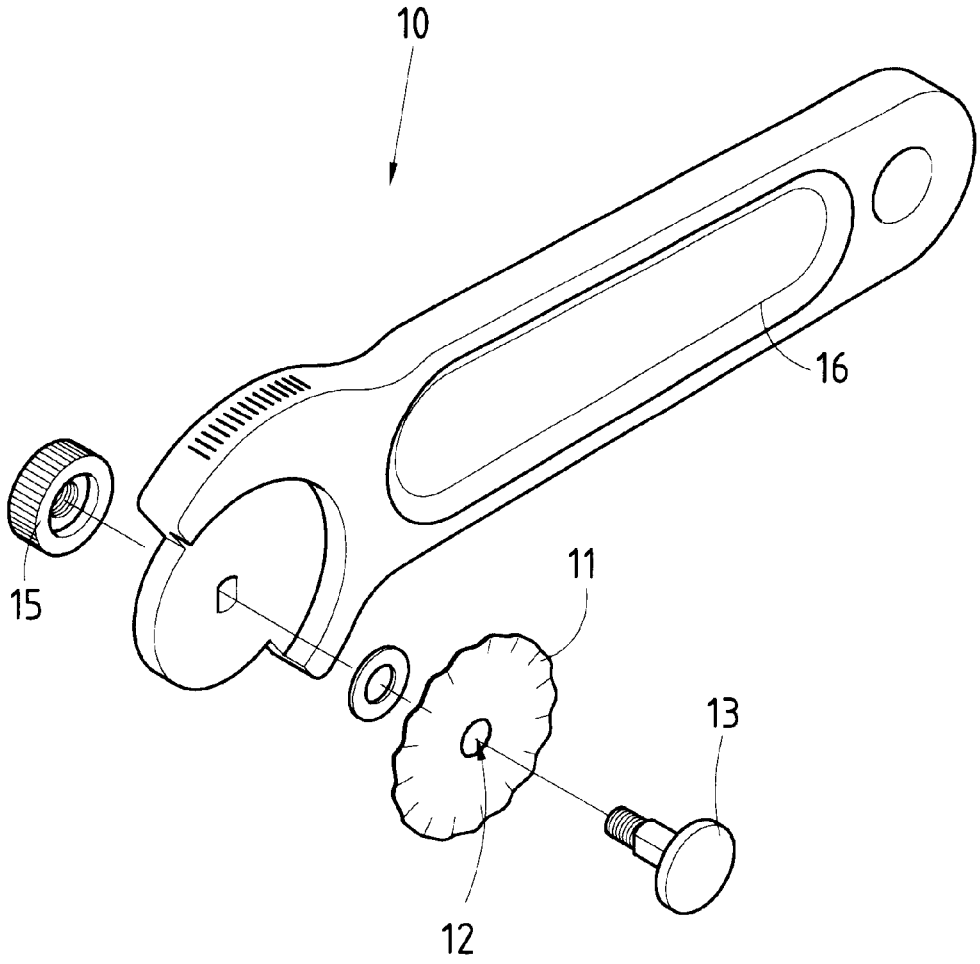
FIG.1 PRIOR ART
FIG. 1 shows an exploded view of a cutting tool of the prior art.
Figure 4:
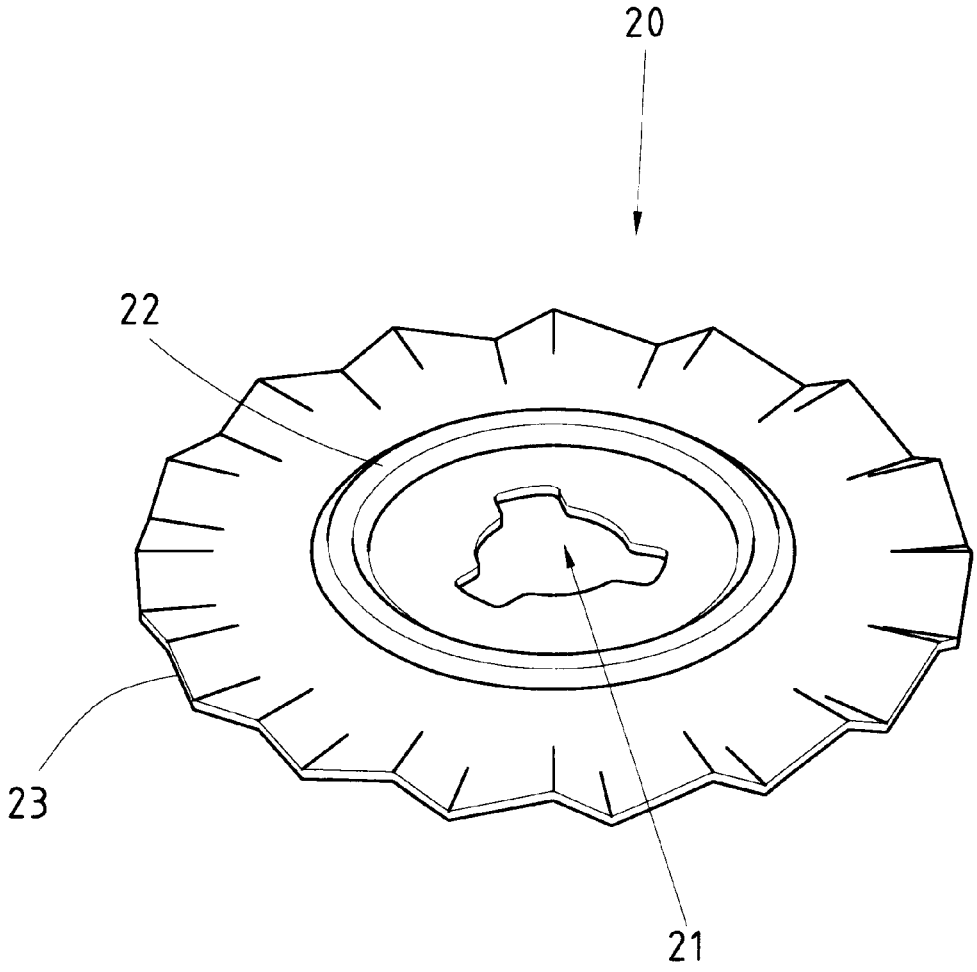
FIG. 4 shows a perspective view of a circular blade of the present invention.
Figure 5:
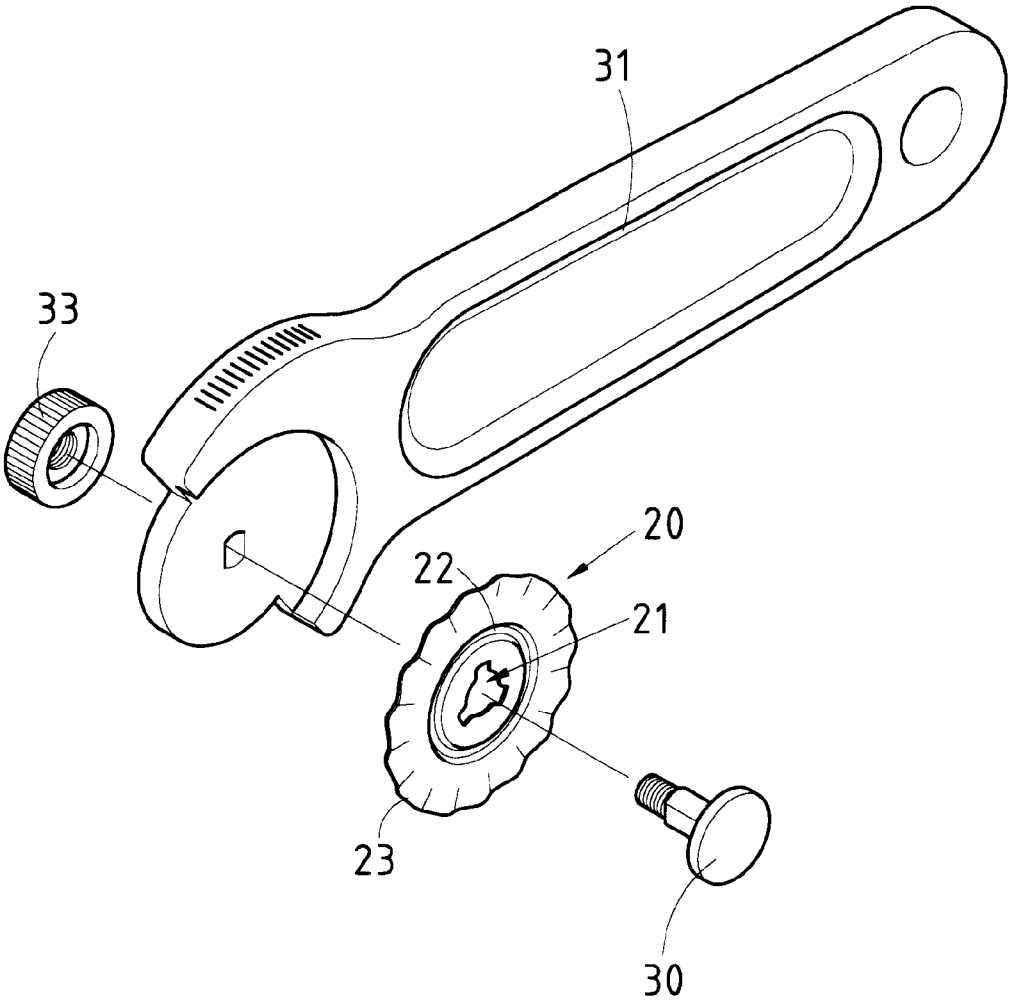
FIG. 5 shows an exploded view of a cutting tool comprising the circular blade of the present invention as shown in FIG. 4.

As shown in FIGS. 4–7, a circular blade 20 of the present invention is provided in the center with a fastening hole 21 to facilitate the fastening of the circular blade 20 to one end of a cutting tool handle 31 by a locating element 30 and a nut 33, as illustrated in FIG. 5.

The circular blade 20 of the present invention is further provided with a reinforcing portion 22 having a predetermined width and thickness. In other words, the reinforcing portion 22 is raised from the surface of one side of the circular blade 20 such that the reinforcing portion 22 circumvents the fastening hole 21.

The circular blade 20 of the present invention has a cutting edge 23, which is regularly serrated, or irregularly serrated, as illustrated in FIGS. 8A–8D.

The reinforcing portion 22 serves to strengthen the structure of the circular blade 20 of the present invention, and to prevent the deformation of the circular blade 20 in the finishing process. When the circular 20 is being finished, the reinforcing portion 22 serves to eliminate the metal internal stress, thereby preventing the deformation of the circular blade 20.

Figure 6:
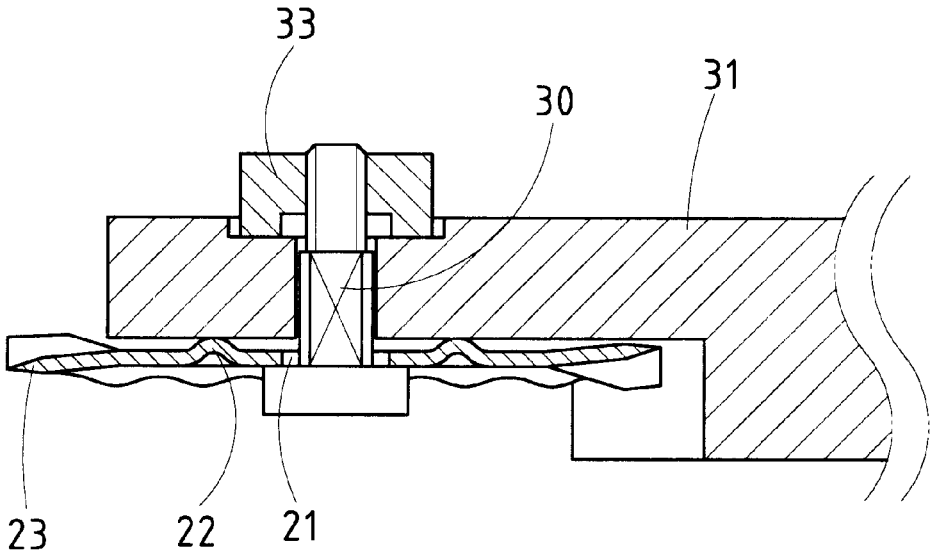
FIG. 6 shows a sectional view of the circular blade of the present invention and other component parts of the cutting tool as shown in FIG. 5.
Figure 7:
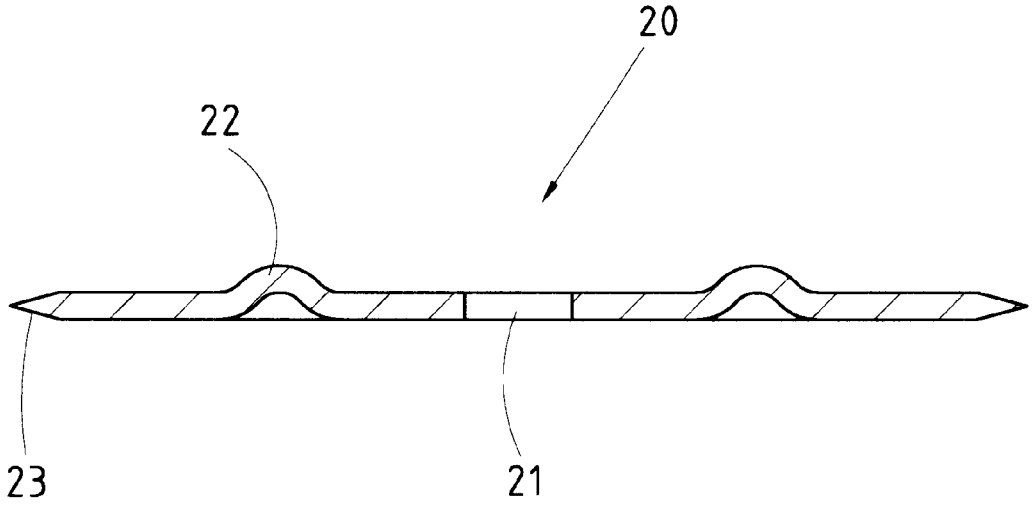
FIG. 7 shows a sectional view of the circular blade of the present invention.

As shown in FIG. 6, the reinforcing portion 22 serves to reduce the contact area between the circular blade 20 of the present invention and the cutting tool handle 31 to which the circular blade 20 is fastened by the locating element 30 in conjunction with the nut 33.

The present invention described above is to be regarded in all respects as being merely illustrative, and not restrictive. Accordingly, the present invention may be embodied in other specific forms without deviating from the spirit thereof. The present invention is therefore to be limited only by the scope of the following claim.

I claim:

1. A cutting apparatus comprising:

a circular blade having a cutting edge at a periphery thereof, said circular blade having a fastening hole formed in a center thereof, said circular blade having an annular reinforcing protrusion formed therein and extending outwardly from a plane of one side of said blade, said annular reinforcing protrusion being entirely radially spaced from and extending around said fastening hole, said protrusion located between said cutting edge and said fastening hole, said circular blade having an annular indentation formed on an opposite side of said blade corresponding in location entirely with said annular reinforcing protrusion;

a cutting tool having a single planar receptacle surface and a handle extending outwardly therefrom, said annular reinforcing protrusion having an outer surface juxtaposed against a planar receptacle surface, said receptacle surface having a hole formed therein, said opposite said of said circular blade being exposed on a side of said cutting tool opposite said planar receptacle surface;

a locating element extending through said fastening hole of said blade and said hole of said receptacle surface; and a nut secured to an end of said locating element such that said blade is retained against said receptacle surface.

* * * * *